US011643296B2

(12) United States Patent
Stewart et al.

(10) Patent No.: US 11,643,296 B2
(45) Date of Patent: May 9, 2023

(54) EXPANDABLE REEL ASSEMBLY FOR A WELL SYSTEM

(71) Applicant: EnQuest Energy Solutions, LLC, Houston, TX (US)

(72) Inventors: Jamie Stewart, Houston, TX (US); Christopher Vincer, Houston, TX (US); Gregory L. Pipal, Houston, TX (US); Doyle Harrington, Houston, TX (US); Derrick Daigle, Houston, TX (US)

(73) Assignee: EnQuest Energy Solutions, LLC, Houston, TX (US)

( * ) Notice: Subject to any disclaimer, the term of this patent is extended or adjusted under 35 U.S.C. 154(b) by 0 days.

(21) Appl. No.: 17/321,157

(22) Filed: May 14, 2021

(65) Prior Publication Data

US 2021/0354951 A1 Nov. 18, 2021

Related U.S. Application Data

(60) Provisional application No. 63/025,322, filed on May 15, 2020.

(51) Int. Cl.

| | |
|---|---|
| ***E21B 19/00*** | (2006.01) |
| ***E21B 19/22*** | (2006.01) |
| ***B65H 75/24*** | (2006.01) |

(52) U.S. Cl.

CPC ..... *B65H 75/243* (2013.01); *E21B 19/008* (2013.01); *E21B 19/22* (2013.01)

(58) Field of Classification Search

CPC ..... E21B 19/008; E21B 19/22; B65H 75/242; B65H 75/243

See application file for complete search history.

(56) References Cited

U.S. PATENT DOCUMENTS

| | | | | |
|---|---|---|---|---|
| 5,738,173 | A * | 4/1998 | Burge | E21B 19/08 166/77.3 |
| 6,460,796 | B1 * | 10/2002 | Berning | B65H 75/24 137/355.16 |
| 8,985,496 | B2 * | 3/2015 | Dillinger | B65H 75/242 242/577.3 |
| 11,186,463 | B1 * | 11/2021 | Franklin-Hensler | B65H 75/4468 |
| 11,235,946 | B2 * | 2/2022 | Barnett | E21B 19/22 |
| 2020/0324997 | A1 * | 10/2020 | Garcia | B65H 75/243 |

FOREIGN PATENT DOCUMENTS

| | | | | |
|---|---|---|---|---|
| CN | 106593328 | A * | 4/2017 | E21B 19/22 |

* cited by examiner

*Primary Examiner* — Matthew R Buck
(74) *Attorney, Agent, or Firm* — Conley Rose, P.C.

(57) ABSTRACT

An expandable reel for a well system includes a support frame configured to receive a torque from a motor, and a core assembly configured to couple to the support frame and receive a tubular of the well system about an outer surface of the core assembly, wherein the core assembly is actuatable between a first configuration and a second configuration while remaining coupled to the support frame, wherein the core assembly includes a first outer diameter when in the first configuration and a second outer diameter when in the second configuration that is different from the first outer diameter.

18 Claims, 13 Drawing Sheets

EXPANDABLE REEL ASSEMBLY FOR A WELL SYSTEM

CROSS-REFERENCE TO RELATED APPLICATIONS

This application claims benefit of U.S. provisional patent application Ser. No. 63/025,322 filed May 15, 2020, and entitled "Expandable Reel Assembly for a Well System," which is hereby incorporated herein by reference in its entirety for all purposes.

STATEMENT REGARDING FEDERALLY SPONSORED RESEARCH OR DEVELOPMENT

Not applicable.

BACKGROUND

Coiled tubing systems are used to run continuous pipe into and out of wellbores. Continuous pipe may be referred to as coiled tubing because it is stored on a coiled tubing reel. Coiled tubing can be used for drilling operations, and is likewise well-suited for servicing and/or producing hydrocarbons from existing wells. Coiled tubing can be inserted into and removed from a wellbore extending through a subterranean earthen formation without having to first erect a complex drilling rig or other structure at a well site at which the wellbore is located. During operation, a coiled tubing of the coiled tubing may be subjected to bending and associated bending strains at varying bending radii. Additionally, the coiled tubing may have a minimum allowable bend radius the coiled tubing is designed to sustain, where the minimum allowable bend radius of the coiled tubing may be a function of the diameter and other properties of the coiled tubing. The reel of the coiled tubing system may be designed such that the coiled tubing does not exceed its designed bending radius when the coiled tubing is stored on the reel.

BRIEF SUMMARY OF THE DISCLOSURE

An embodiment of an expandable reel for a well system comprises a support frame configured to receive a torque from a motor, and a core assembly configured to couple to the support frame and receive a tubular of the well system about an outer surface of the core assembly, wherein the core assembly is actuatable between a first configuration and a second configuration while remaining coupled to the support frame, wherein the core assembly comprises a first outer diameter when in the first configuration and a second outer diameter when in the second configuration that is different from the first outer diameter. In some embodiments, the expandable reel comprises an actuation assembly coupled to the support frame and configured to actuate the core assembly between the first configuration and the second configuration. In some embodiments, the actuation assembly comprises a cylinder coupled to the support frame and a piston at least partially disposed in the cylinder and coupled to the core assembly, wherein the piston is extendable from the cylinder. In certain embodiments, the expandable reel comprises a control system operable by a user of the expandable reel and configured to selectably operate the actuation assembly to actuate the core assembly between the first configuration and the second configuration. In certain embodiments, the core assembly comprises a plurality of circumferentially spaced panel assemblies configured to radially translate relative to a central axis of the expandable reel in response to actuation of the actuation assembly. In some embodiments, each panel assembly comprises an arcuate panel and a support member coupled to the arcuate panel, wherein the arcuate panel comprises a radially outer surface that defines an outer surface of the core assembly and wherein the support member is configured to couple to the actuation assembly. In some embodiments, the support frame comprises a pair of inner spoke assemblies, a plurality of core support members positioned radially between the plurality of panel assemblies and a central axis of the expandable reel, and a pair of outer spoke assemblies, wherein the plurality of panel assemblies are positioned between the pair of outer spoke assemblies. In certain embodiments, each panel assembly comprises a guide assembly configured to slidably engage an outer spoke of one of the outer spoke assemblies.

An embodiment of an expandable reel for a well system comprises a support frame configured to receive a torque from a motor, and a core assembly configured to couple to the support frame and receive a tubular of the well system about an outer surface of the core assembly, wherein the core assembly comprises a plurality of circumferentially spaced panel assemblies that are radially translatable relative to a central axis of the expandable reel. In some embodiments, a circumferential spacing between each of the plurality of panel assemblies is increased in response in response the actuation of the core assembly between a first configuration and a second configuration when coupled to the support frame. In some embodiments, each panel assembly comprises an arcuate panel and a support member coupled to the arcuate panel, wherein the arcuate panel comprises a radially outer surface that defines an outer surface of the core assembly and wherein the support member is configured to couple to the actuation assembly. In certain embodiments, the support frame comprises a pair of inner spoke assemblies, a plurality of core support members positioned radially between the plurality of panel assemblies and a central axis of the expandable reel, and a pair of outer spoke assemblies, wherein the plurality of panel assemblies are positioned between the pair of outer spoke assemblies. In some embodiments, each panel assembly comprises a guide assembly configured to slidably engage an outer spoke of one of the outer spoke assemblies. In certain embodiments, the guide assembly is configured to limit the core assembly to a single degree of freedom relative to the support frame. In certain embodiments, the core assembly is actuatable between a first configuration and a second configuration when coupled to the support frame, and wherein the core assembly comprises a first outer diameter when in the first configuration and a second outer diameter that is different from the first outer diameter. In some embodiments, the expandable reel comprises an actuation assembly coupled to the support frame and configured to actuate the core assembly between the first configuration and the second configuration.

An embodiment of a method for operating an expandable reel for a well system comprises (a) actuating a core assembly of the expandable reel between a first configuration comprising a first outer diameter and a second configuration comprising a second outer diameter that is different from the first outer diameter. In some embodiments, the method comprises (b) operating the expandable reel to reel or unreel a first tubular having a first diameter from the core assembly when the core assembly is in the first configuration, and (c) operating the expandable reel to reel or unreel a second tubular having a second diameter from the core assembly when the core assembly is in the second configuration, wherein the second diameter is different from the first diameter. In some embodiments, (a) comprises increasing a circumferential spacing between each of a plurality of panel assemblies of the core assembly. In certain embodiments, (a) comprises operating an actuation assembly of the expandable reel to actuate the core assembly between the first configuration and the second configuration.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of exemplary embodiments of the disclosure, reference will now be made to the accompanying drawings in which.

DETAILED DESCRIPTION OF EXEMPLARY EMBODIMENTS

Figure 1:
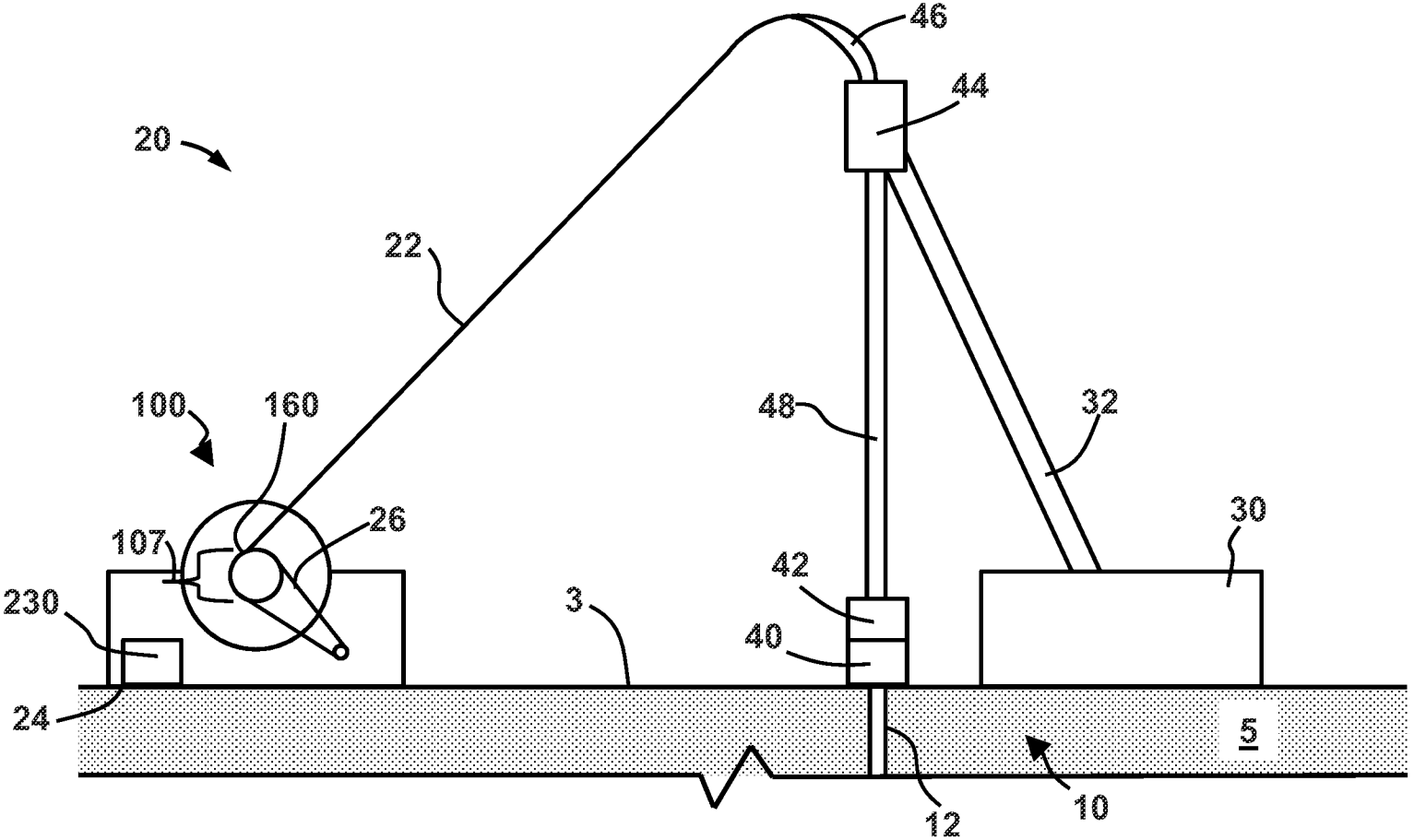
FIGS. 1, 2 are schematic views of an embodiment of a well system including a coiled tubing system in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness. Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

As previously described, coiled tubing systems may include a reel assembly and a coiled tubing which may be spooled or stored on a core of the reel assembly. The coiled tubing may have a minimum allowable bend radius that may be a function of the diameter and other properties of the coiled tubing. Bending of the coiled tubing at a radius less than the minimum allowable bend radius of the coiled tubing may induce excessive bending strain within the coiled tubing which may damage the coiled tubing or otherwise decrease the operational life of the coiled tubing. Thus, the core of the reel assembly may have an outer diameter sized such that the bend radius to which the coiled tubing is subjected when spooled on the reel assembly is at least as great as the minimum allowable bend radius of the coiled tubing.

During operation of the coiled tubing system, a first coiled tubing may be unspooled the reel assembly and injected into a wellbore using a coiled tubing injector of the coiled tubing system. Additionally, during operation of the coiled tubing system, it may be desirable to retrieve the first coiled tubing from the wellbore and inject a second coiled tubing into the wellbore having properties that differ from the first coiled tubing. For example, it may be desirable to inject a coiled tubing having a diameter, and thus a minimum allowable bend radius, that differs from the diameter of the first coiled tubing for various reasons. For instance, it may be desirable to position a tool within the wellbore which requires a coiled tubing having a diameter that differs from the diameter of the first coiled tubing.

In conventional coiled tubing systems, in order to replace a first coiled tubing having a first diameter with a second coiled tubing having a second diameter, a first core of the reel assembly of the coiled tubing system must be replaced with a second core having an outer diameter that differs from the outer diameter of the first core. For instance, if the second coiled tubing has a larger diameter than thus a larger minimum allowable bend radius, the first core of the reel assembly may be replaced by a second core having a larger outer diameter to ensure the second coiled tubing is not subjected to bends having a radius less than the minimum allowable bend radius of the second coiled tubing. The need to replace the core of the reel assembly of the coiled tubing system may introduce delays and extend the overall time and expense required in replacing the coiled tubing of the coiled tubing system, thereby increasing the overall time and expense required in performing a coiled tubing operation.

Embodiments disclosed herein include expandable reels for well systems that include a core assembly configured to receive a tubular of the well system and actuate between a first configuration and a second configuration when coupled to the support frame, wherein the core assembly comprises a first outer diameter when in the first configuration and a second outer diameter that is different from the first outer diameter. Additionally, embodiments disclosed herein include expandable reels for wells systems that include a core assembly configured to couple to the support frame and receive a tubular of the well system, wherein the core assembly comprises a plurality of circumferentially spaced panel assemblies that are radially translatable relative to a central axis of the expandable reel. Further, embodiments disclosed herein include methods for operating expandable reels for well systems that include actuating a core assembly of the expandable reel between a first configuration comprising a first outer diameter and a second configuration comprising a second outer diameter that is different from the first outer diameter. In this manner, embodiments of core assemblies disclosed herein may be actuated between a plurality of configurations configured to receive a plurality of tubulars (e.g., coiled tubing strings) having varying minimum bend radii without needing to remove or exchange the core assembly.

Referring to FIG. 1, an embodiment of a well system 10 comprising a coiled tubing system 20 located at a surface 3 of a wellbore 12 is shown. In the embodiment of FIG. 1, well system 10 comprises a system for servicing or completing the wellbore 12 which extends through a subterranean earthen formation 5; however, in other embodiments, well system 10 may comprise a system for drilling wellbore 12 or a system for producing hydrocarbons from wellbore 12.

Coiled tubing system 20 is generally configured to inject or stab coiled tubing (e.g., first coiled tubing 22 shown in FIG. 1) into wellbore 12 and/or pull or retract coiled tubing 22 from wellbore 12. In this embodiment, coiled tubing system 20 generally includes a reel truck 24 comprising an expandable reel 100 rotatable by a motor 26, a mast truck 30 comprising a mast 32, a wellhead 40, a blowout preventer (BOP) 42, and a coiled tubing injector 44; however, in other embodiments, the configuration of coiled tubing system 20 may vary.

During operation of coiled tubing system 20, first coiled tubing 22 may be unwound from a core assembly 160 of the expandable reel 100 in response to the operation of motor 26. The unwinding from, and winding onto, core assembly 160 of first coiled tubing 22 may be performed or assisted by a tubing tensioner (not shown) of reel truck 24 that is powered by a hydraulic unit. The displacement of first coiled tubing 22 into and out of wellbore 12 may also be facilitated by a guide arch 46 extending from coiled tubing injector 44. Mast 32 of coiled tubing system 20 extends telescopically from mast truck 30 and is coupled to and physically supports coiled tubing injector 44 at a location distal mast truck 30. Along with being telescopically adjustable, mast 32 may also be swiveled or rotated relative to mast truck 30 to control the positioning of coiled tubing injector 44 relative to wellbore 12. In this manner, mast 32 may align coiled tubing injector 44 with wellhead 40 and BOP 42 to ensure smooth feeding of coiled tubing 22 into and out of wellbore 12.

Wellhead 40 is positioned at the surface of wellbore 12 and physically supports BOP 42 which is mounted or coupled thereto. BOP 42 may be used to control the circulation of fluids from wellbore 12 and the surrounding environment at the surface 3. In this embodiment, a lubricator string 48 extends from BOP 42 to coiled tubing injector 44, where lubricator string 48 provides lubrication to coiled tubing 22 as first coiled tubing 22 is extended into or retracted from wellbore 12. A variety of tools may be coupled to the terminal end of coiled tubing 22 for performing various operations in wellbore 12. For example, a perforating tool may be coupled to the terminal end of first coiled tubing 22 for selectably perforating a casing string positioned in wellbore 12 whereby fluid connectivity between formation 5 and wellbore 12 may be enhanced. Reel truck 24 may include a control room (not shown) for transmitting signals to and receiving signals from (e.g., electronic signals and/or data) tools attached to the terminal end of first coiled tubing 22. Additionally, fluids may be transported between reel truck 24 and tools attached to the terminal end of first coiled tubing 22 via one or more fluid flow passages extending through coiled tubing 22.

First coiled tubing 22 comprises a first diameter and a corresponding first minimum allowable bend radius. The core assembly 160 of expandable reel 100 comprises a first or retracted configuration shown in FIG. 1 in which core assembly 160 comprises a first outer diameter 107 sufficiently large such that the bend radius of first coiled tubing 22 when wound about core assembly 160 is not less than the first minimum allowable bend radius.

Figure 2:
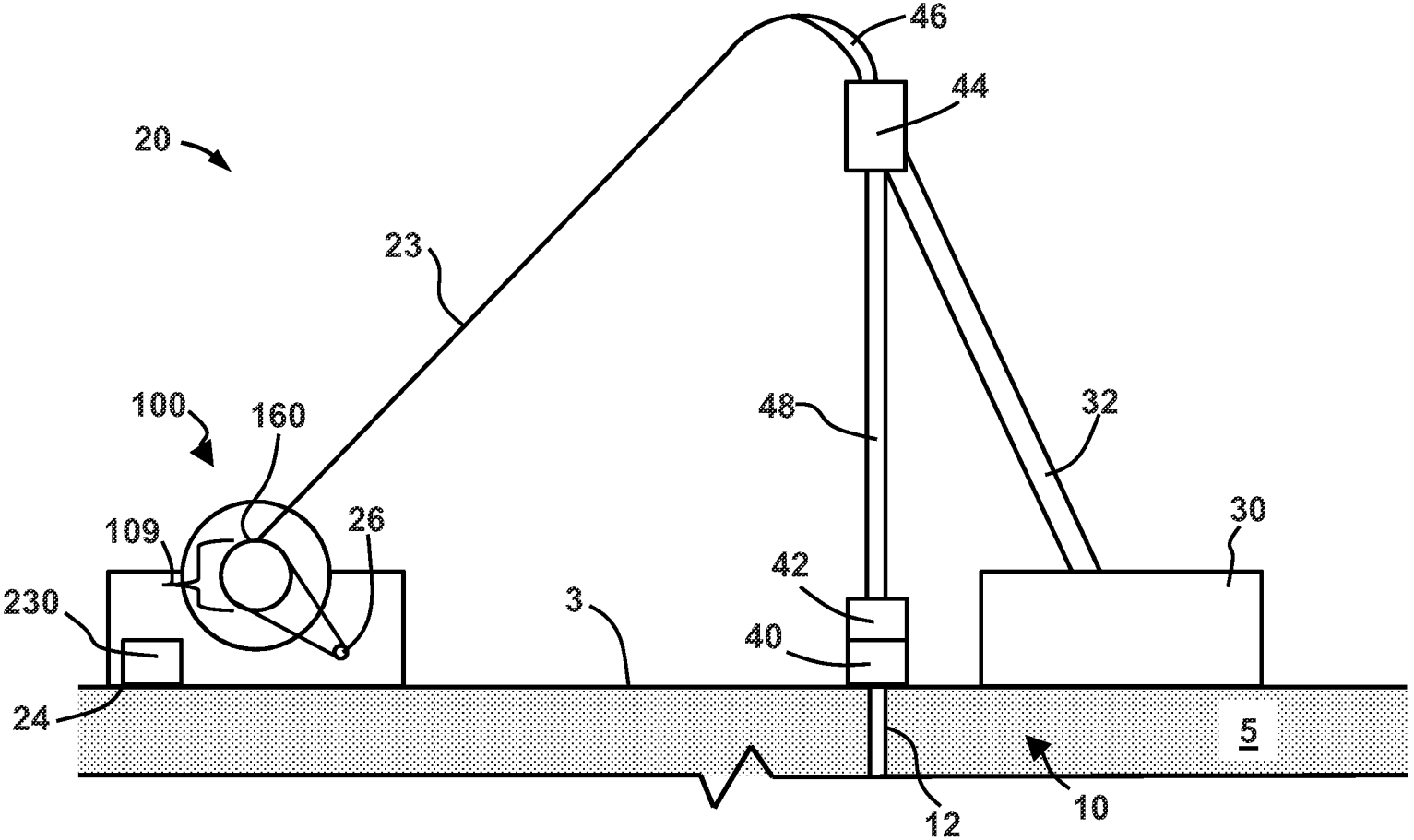

Referring to FIGS. 1, 2, as described above, it may desirable during the operation coiled tubing system 20 to exchange the first coiled tubing 22 (shown in FIG. 1) for a second coiled tubing 23 (shown in FIG. 2) comprising a second diameter and a corresponding second minimum allowable bend radius that is larger than the first minimum allowable bend radius of first coiled tubing 22. For instance, it may desirable to deploy a tool in wellbore 12 requiring a coiled tubing having a larger diameter than first coiled tubing 22.

As will be discussed further herein, the core assembly 160 of expandable reel 100 may be reconfigurable between the retracted configuration shown in FIG. 1, where core assembly 160 has a first outer diameter 107, and a second or expanded configuration shown in FIG. 2 where core assembly 160 has a second outer diameter 109 that is different form the first outer diameter 107. Particularly, the second outer diameter 109 of core assembly 160 may be larger than the first outer diameter 107 and have a size sufficient such that the bend radius of second coiled tubing 23 when wound about core assembly 160 is not less than the second minimum allowable bend radius of second coiled tubing 23. In this manner, the outer diameter of core assembly 160 of expandable reel 100 may be adjusted between a plurality of outer diameters (e.g., outer diameters 107, 109) without needing to replace at least some components of core assembly 160, decreasing the amount of time and expense (due to e.g., increased time as well as the need for additional components) required for exchanging a first coiled tubing (e.g., first coiled tubing 22) having a first minimum allowable bend radius for a second coiled tubing (e.g., second coiled tubing 23) having a second bend radius that is different from the first bend radius. In some embodiments, the core assembly 160 may be reconfigurable between three or more configurations providing three or more different outer diameters.

Figure 3:
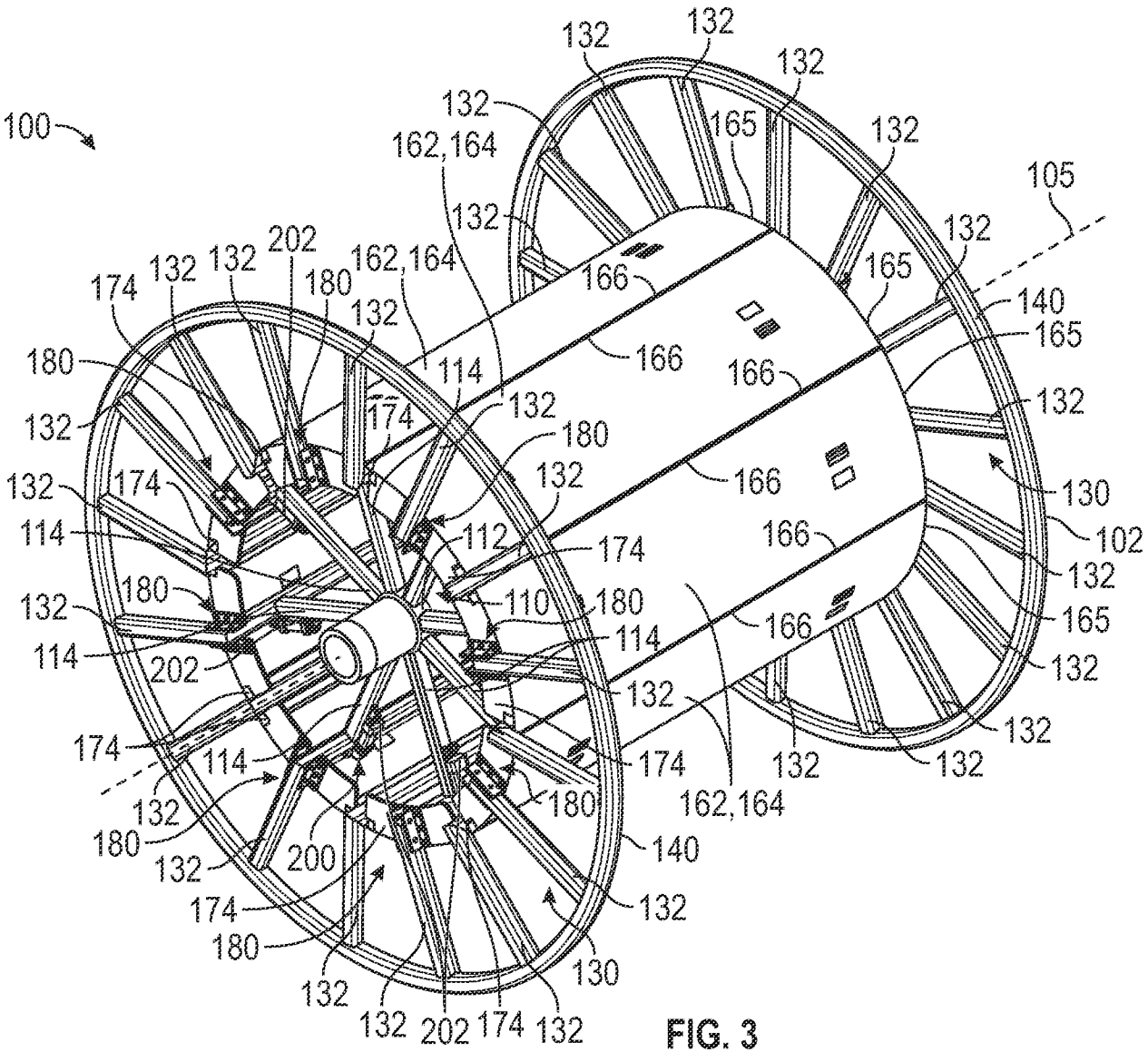
FIG. 3 is a perspective view of an embodiment of an expandable reel of the well system of FIGS. 1, 2 in accordance with principles disclosed herein.
Figure 4:
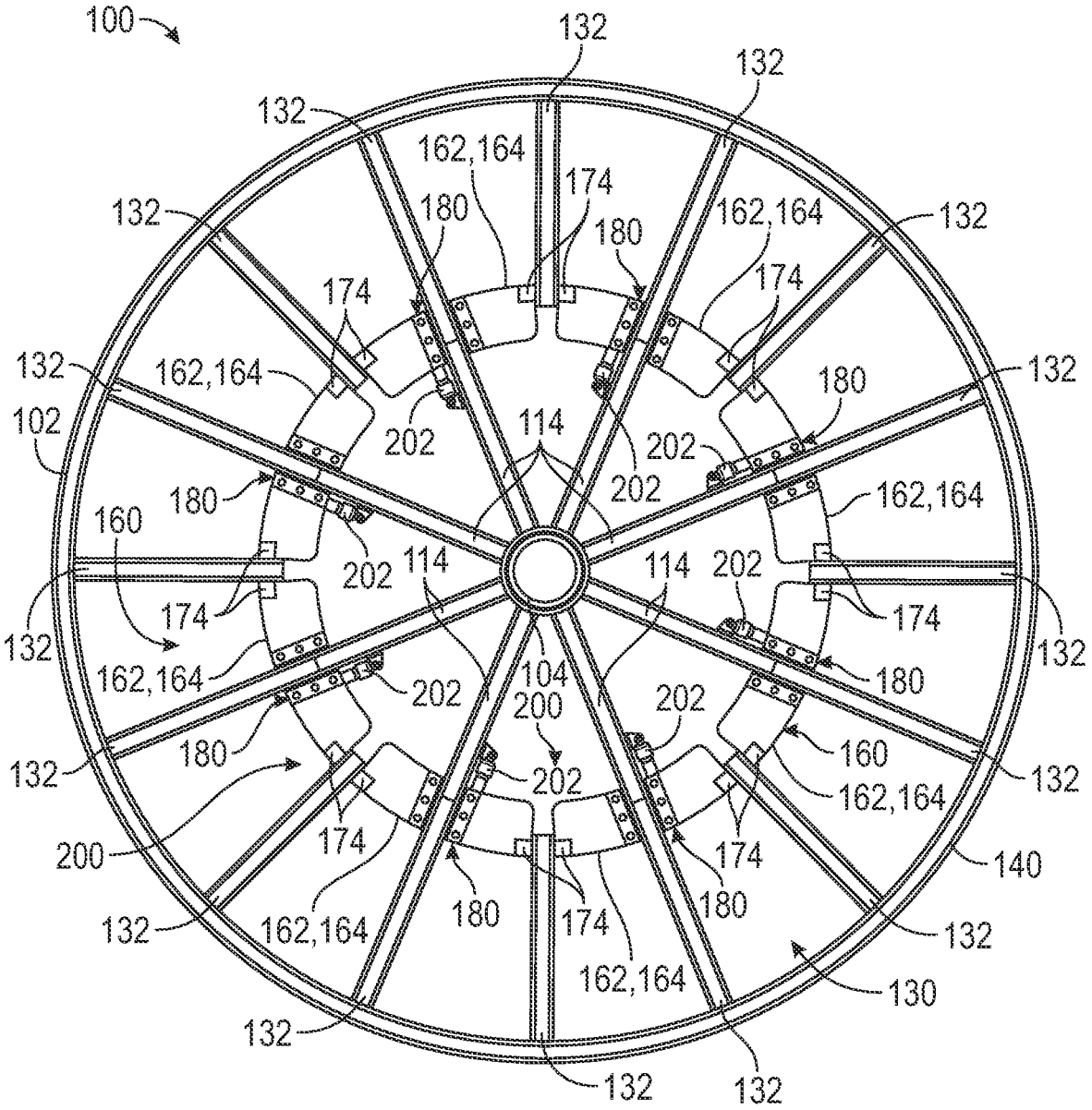
FIG. 4 is a side view of the expandable reel of FIG. 3.
Figure 5:
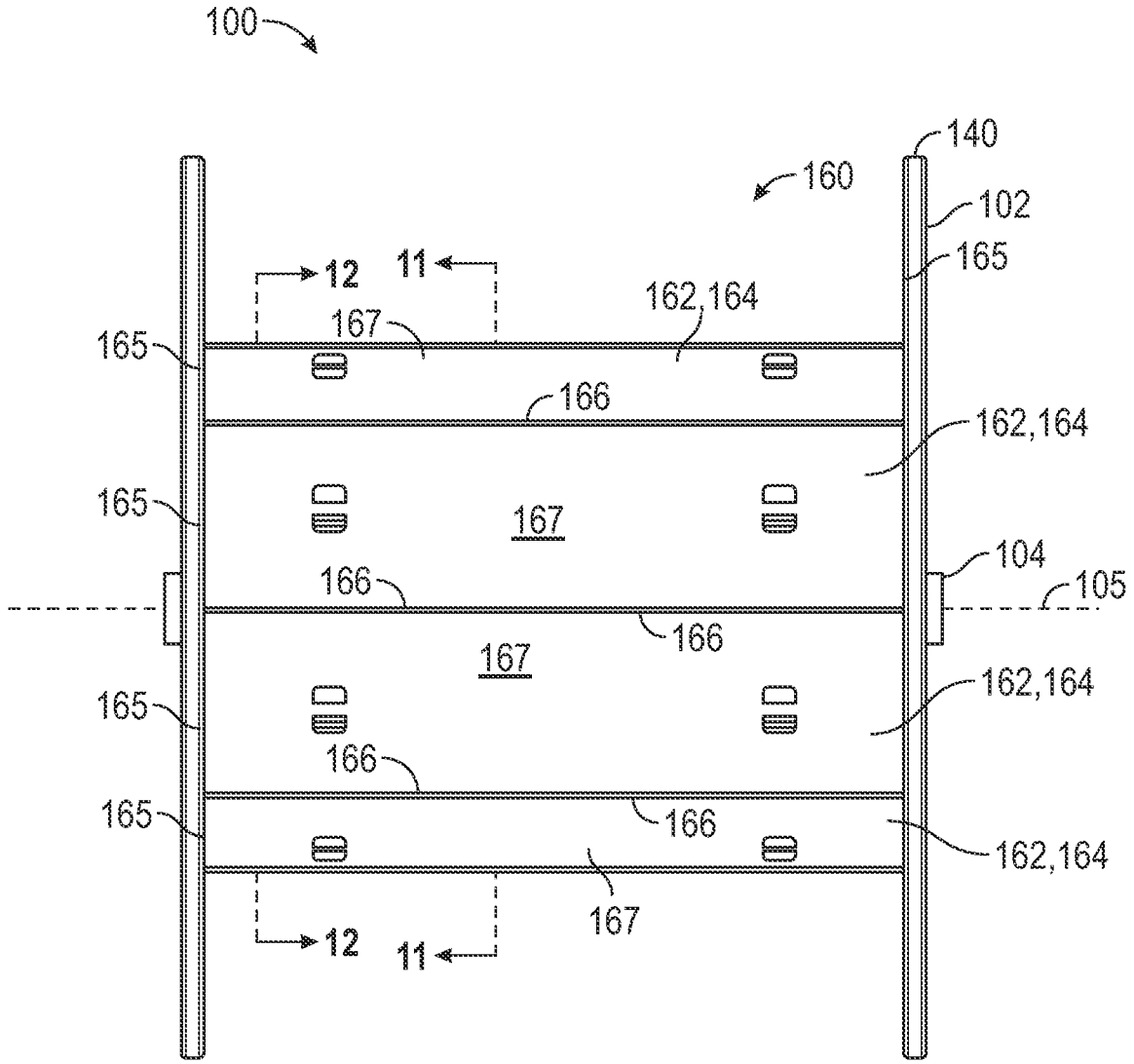
FIG. 5 is a top view of the expandable reel of FIG. 3.

Referring to FIGS. 3-5, an embodiment of the expandable reel 100 for the well system 10 of FIGS. 1, 2 is shown in FIGS. 3-5. Expandable reel 100 is rotatable about a central or longitudinal axis 105, and generally includes a support frame 102, a core assembly 160, and an actuation assembly 200. While expandable reel 100 is described above as comprising a component of the coiled tubing system 20 shown in FIGS. 1, 2, expandable reel 100 may be used in a variety of coiled tubing systems, as well as other systems associated with the drilling, completion, and production of hydrocarbons from subterranean, earthen wellbores.

Figure 6:
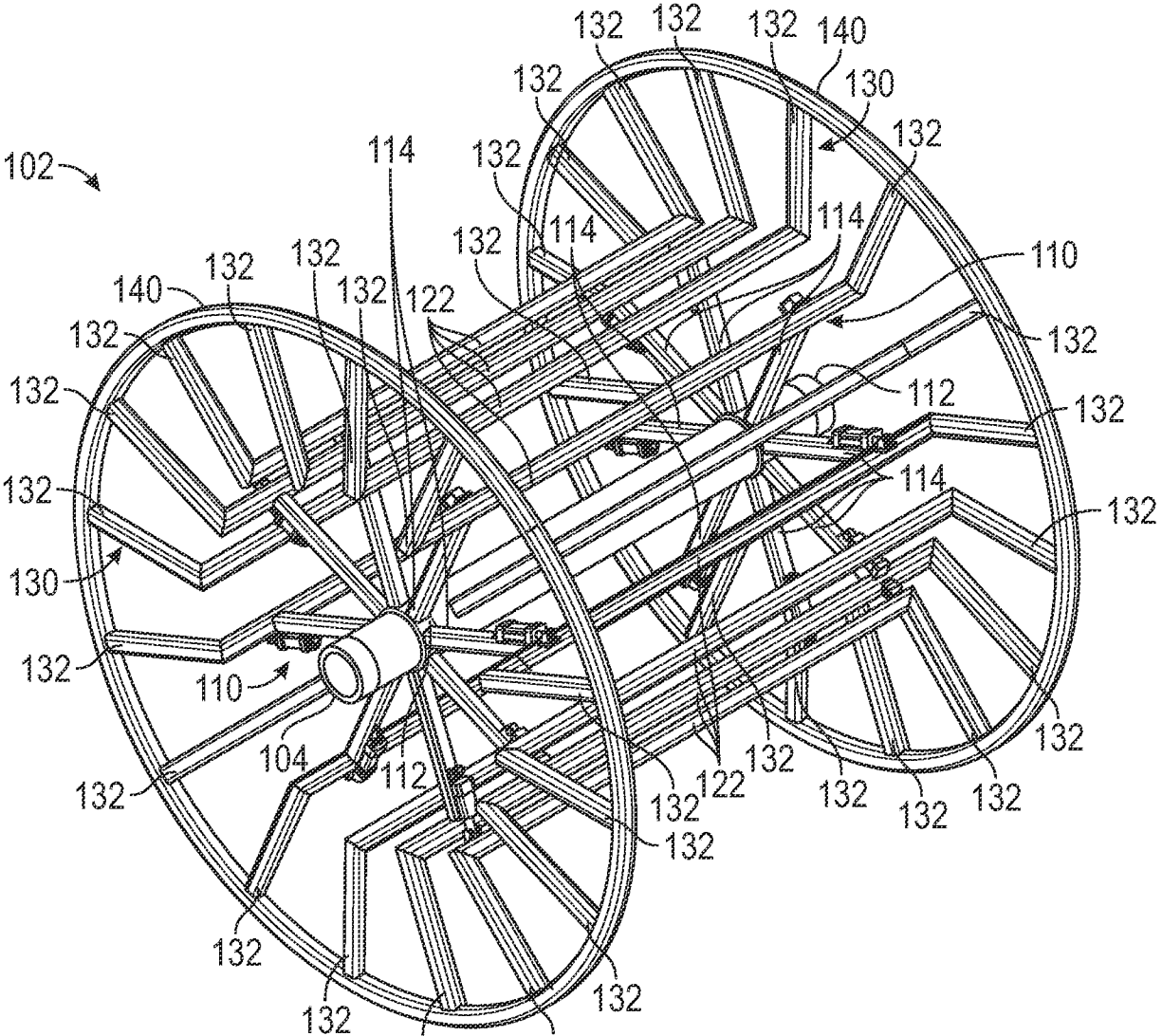
FIG. 6 is a perspective view of an embodiment of a support frame of the expandable reel of FIG. 3 in accordance with principles disclosed herein.
Figure 7:
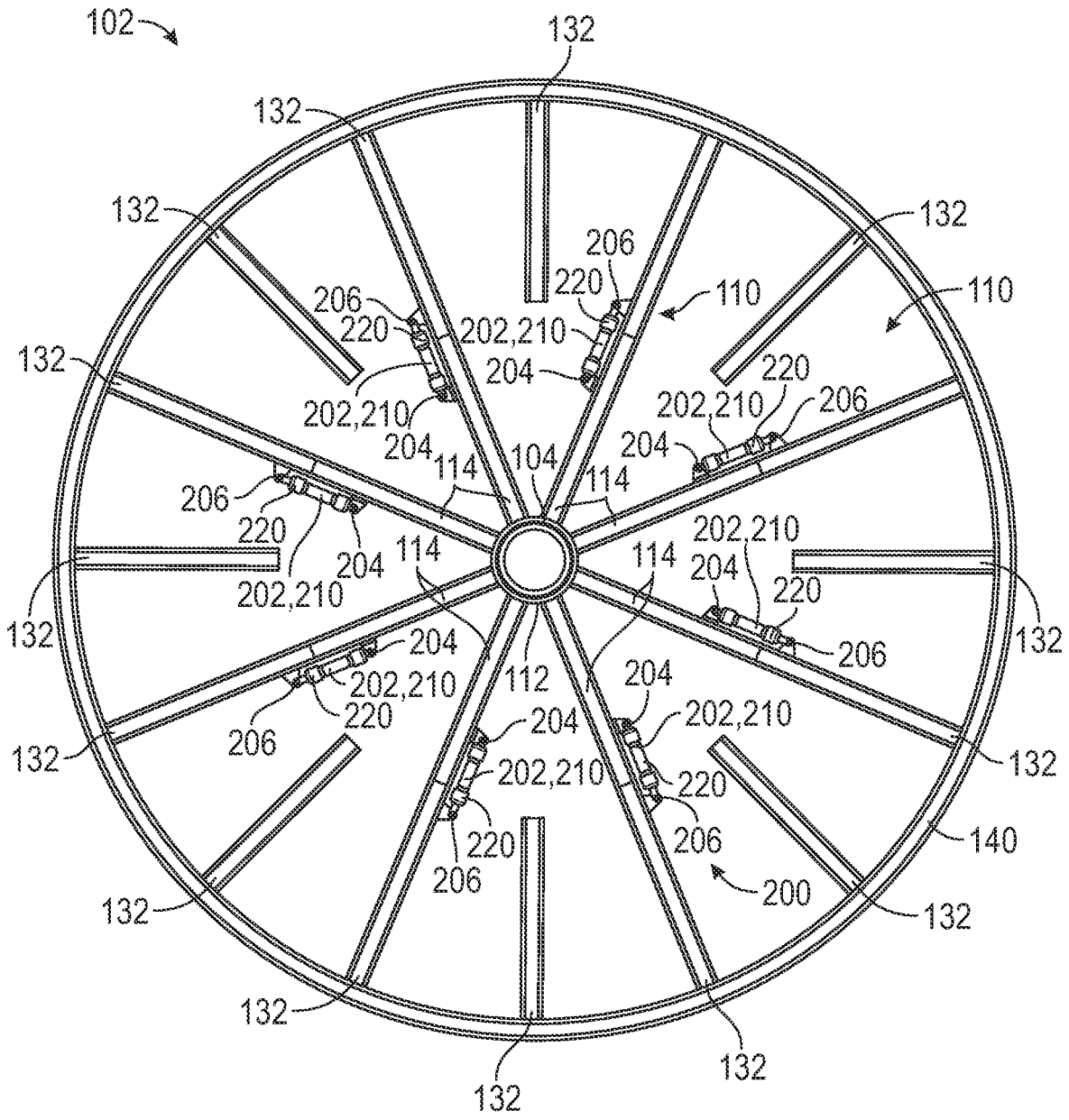
FIG. 7 is a side view of the support frame of FIG. 6.

Referring to FIGS. 6, 7, views of the support frame 102 of expandable reel 100 are shown. Support frame 102 is generally configured to physically support the core assembly 160 and actuation assembly 200 of expandable reel 100. Additionally, support frame 102 may couple expandable reel 100 with motor 26 whereby torque may be transmitted from motor 26 to expandable reel 100. Support frame 102 generally includes a central axle 104, a pair of inner spoke assemblies 110, a plurality of circumferentially spaced core support members 120, a pair of outer spoke assemblies 130, and a pair of outer hubs 140; however, in other embodiments, the configuration of support frame 102 may vary. In some embodiments, components of support frame 102 (e.g., inner spoke assemblies 110, core support members 120, outer spoke assemblies 130, etc.) may each comprise steel tubing (e.g., square tubing, etc.); however, in other embodiments, the configuration of the components of support frame 102, including the materials forming support frame 102, may vary.

Central axle 104 of support frame 102 is generally cylindrical and central axis 105 of expandable reel 100 extends centrally through a central bore or passage of axle 104. Motor 26 shown in FIGS. 1, 2 may couple with axle 104 to transfer torque to axle 104 and thereby drive the rotation of reel 100. Inner spoke assemblies 110 are positioned proximal longitudinally opposed ends of central axle 104. As shown particularly in FIG. 7, each inner spoke assembly 110 may generally include a generally cylindrical inner collar 112 and a plurality of circumferentially spaced elongate inner spokes 114 which extend radially outwards (relative central axis 105) from the inner collar 112. Inner collar 112 may be coupled to an outer surface of central axle 104, preventing relative rotation between inner spoke assemblies 110 and central axle 104. Additionally, a radially inner end of each inner spoke 114 may be attached (e.g., welded, etc.) to the outer surface of inner collar 112. In other embodiments, each inner spoke 114 may attach directly to the central axle 104 of support frame 102.

The outer spoke assembly 120 of support frame 102 may comprise a plurality of elongate core support members 122 and a pair of outer spoke assemblies 130. Each core support member 122 is radially offset from central axis 105 and extends substantially parallel with the central axle 104 of support frame 102. In this configuration, core support members 122 are positioned about or at least partially surround central axle 104. Core support members 122 may be generally configured to physically support core assembly 160 when core assembly 160 is in the retracted configuration as shown in FIGS. 3-5. Outer spoke assemblies 130 are positioned at longitudinally opposed ends of core support members 122.

Each outer spoke assembly 130 of support frame 102 generally includes a plurality of circumferentially spaced elongate outer spokes 132 which extend radially outwards (relative central axis 105) from core support members 122 to one of the outer hubs 140 of support frame 102. Particularly, an inner in end of each outer spoke 132 is coupled (e.g., welded, etc.) to a longitudinal end of one of the core support members 122 while a radially outer end of the outer spoke 132 is coupled (e.g., welded, etc.) to one of the outer hubs 140. While in some embodiments a pair of outer spokes 132 may be coupled to a corresponding core support member 122, in other embodiments, each core support member 122 and the pair of outer spokes 132 extending from the longitudinal ends thereof may comprise a single, monolithically formed member. Outer hubs 140 of support frame 102 may define a maximum outer diameter of expandable reel 100. Additionally, outer spoke assemblies 130 and outer hubs 140 may assist with retaining a coiled tubing (e.g., coiled tubing 22, 23 shown in FIGS. 1, 2) on core assembly 160 as the coiled tubing is reeled onto or extended from expandable reel 100.

Referring to FIGS. 3-5, 8-10, the core assembly 160 of expandable reel 100 may generally comprise a plurality of arcuate panel assemblies 162. As will be described further herein, arcuate panels assembly 162 may couple to the support frame 102 of expandable reel 100 via actuation assembly 200 whereby arcuate panel assemblies 162 may be radially expanded and retracted relative central axis 105 of expandable reel 100 by actuation assembly 200.

Figure 8:
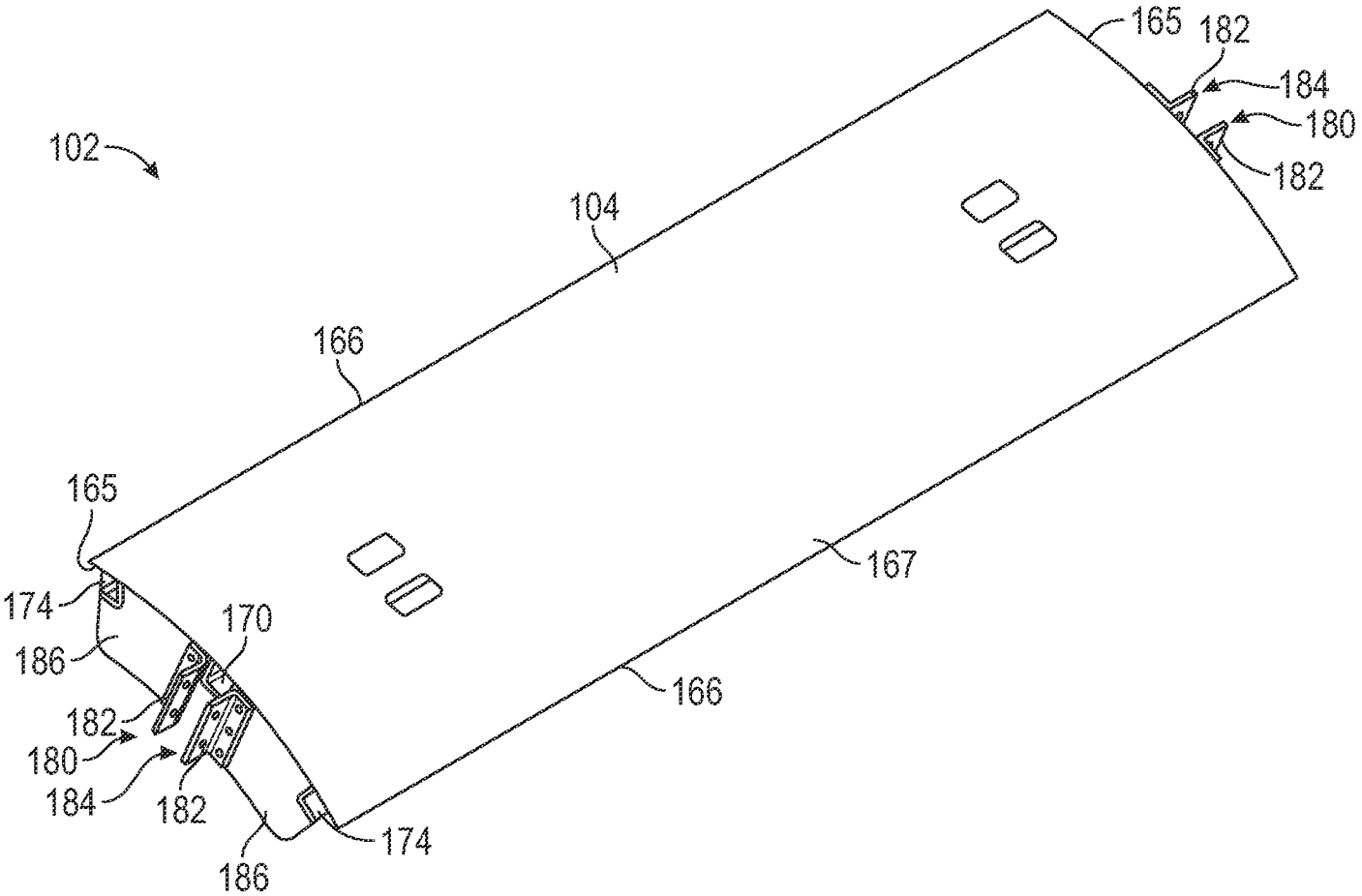
FIG. 8 is a perspective view of an embodiment of an arcuate panel assembly of the expandable reel of FIG. 3 in accordance with principles disclosed herein.
Figure 9:
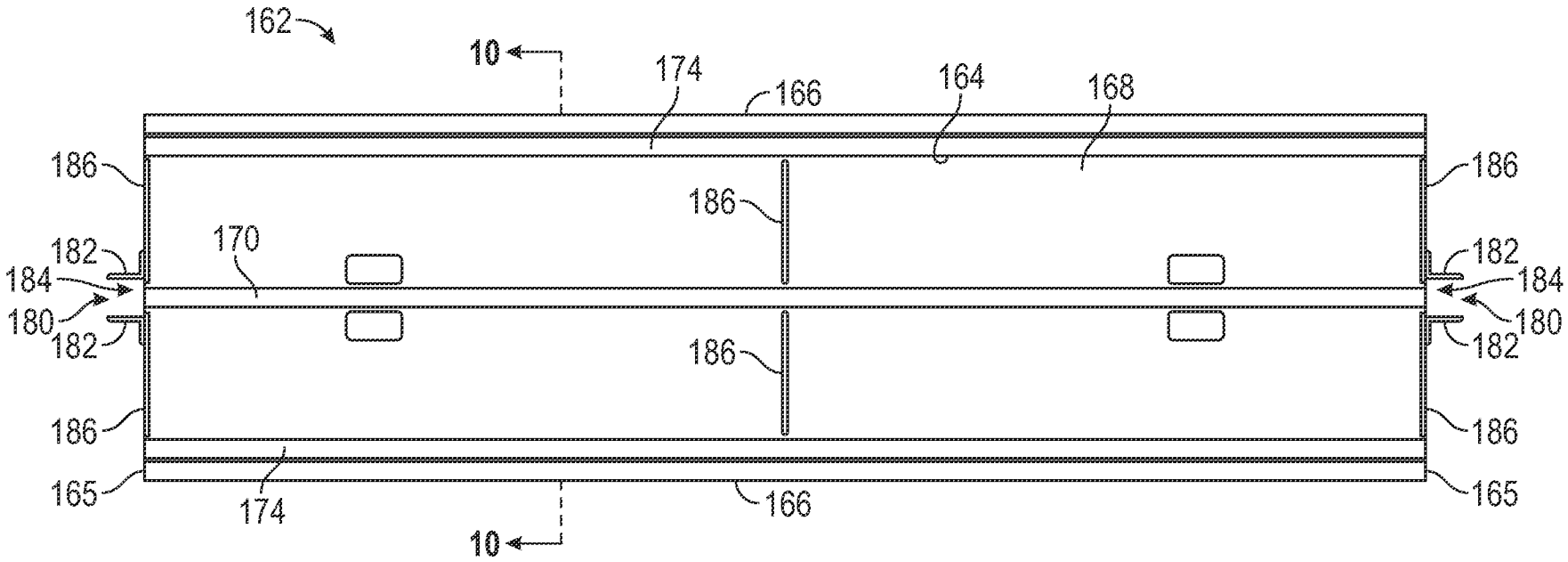
FIG. 9 is a bottom view of the arcuate panel assembly of FIG. 8.
Figure 10:
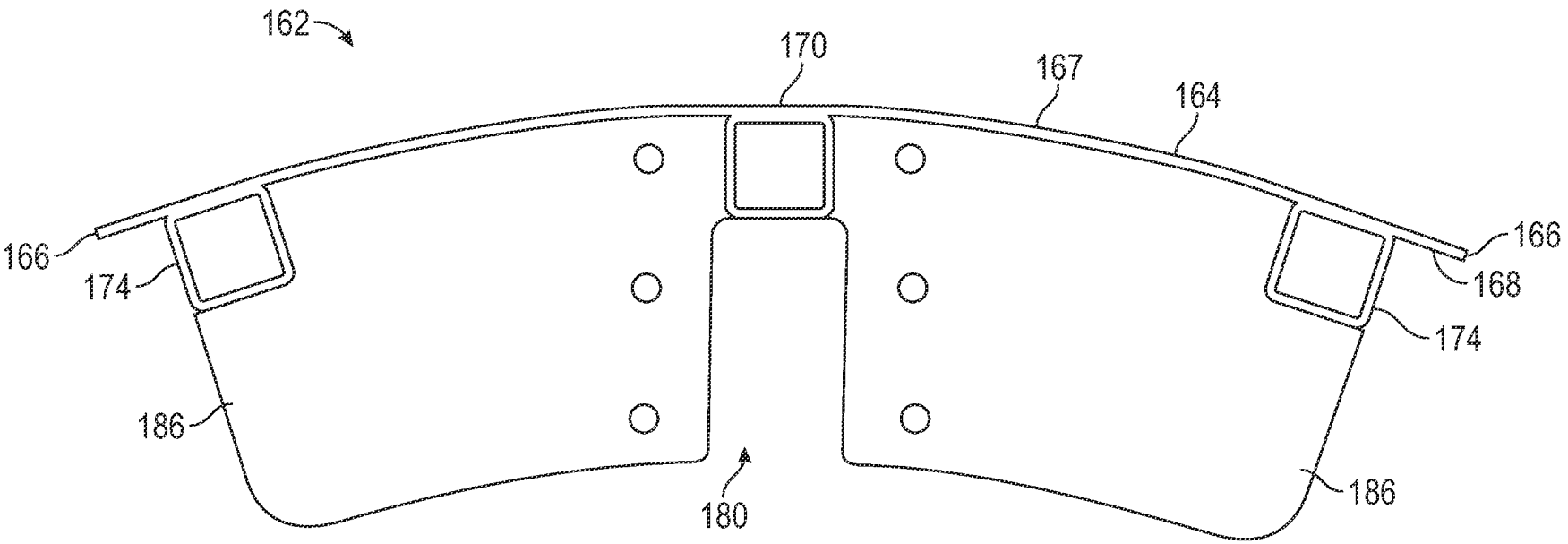
FIG. 10 is a cross-sectional view along lines 10-10 of FIG. 9 of the arcuate panel assembly of FIG. 8.

As shown particularly in FIGS. 8-10, each arcuate panel assembly 162 of core assembly 160 may generally include an arcuate tubing support panel 164, an elongate central support member 170, a pair of outer support members 174, and a pair of guide assemblies 180 located at the opposing ends of the arcuate panel assembly 162. The tubing support panel 164 of each panel assembly 162 is generally configured to physically support tubing coiled about core assembly 160. In this embodiment, tubing support panel 164 comprises a pair of longitudinal ends 165, a pair of lateral sides 166, a radially outer (relative central axis 105) surface 167, and a radially inner surface 168. Radially outer surface 167 of the tubing support panel 164 may physically contact and support or contact a tubular (e.g., coiled tubing 22, 23 shown in FIGS. 1, 2) extending about core assembly 160. The radially outer surfaces 167 of the tubing support panels 164 of core assembly 160 may also define an adjustable or reconfigurable outer diameter (e.g., outer diameters 107, 109 shown in FIGS. 1, 2) of the core assembly 160.

Support members 170, 174 of the panel assembly 162 may each extend longitudinally between the longitudinal ends 165 of tubing support panel 164. Central support member 170 may be positioned centrally between lateral sides 166 of tubing support panel 164 between outer support members 174. Additionally, each outer support member 174 may be positioned proximal one of the lateral sides 166 of tubing support panel 164. Each support member 170, 174 may couple with (e.g., welded to, etc.) the radially inner surface 168 of the tubing support panel 164. In some embodiments, support members 170, 174 of each panel assembly 162 may each comprise steel tubing (e.g., square tubing, etc.); however, in other embodiments, the configuration of support members 170, 174 may vary.

Guide assemblies 180 of each panel assembly 162 may guide the respective panel assembly 162 between a radially inner (relative central axis 105) position corresponding to the retracted configuration of expandable reel 100 and a radially outer position corresponding to the expanded configuration of reel 100. Each guide assembly 180 comprises a pair of opposed guide members 182 that form a radially extending guide receptacle 184 therebetween. Each guide member 182 may couple to an arcuate rib 186 positioned at one of the longitudinal ends 165 of tubing support panel 164. Each arcuate rib 186 may extend orthogonal the radially inner surface 168 of tubing support panel 164 between a radially outer end and a radially inner end. The radially outer end of each arcuate rib 186 may couple with (e.g., welded to, etc.) the radially inner surface 168 of the tubing support panel 164. In some embodiments, a pair of arcuate ribs 186 may be positioned at each longitudinal end 165 of tubing support panel 164. Additionally, in some embodiments, additional arcuate ribs 186 may be positioned between longitudinal ends 165 to provide structural support to the panel assembly 162. For example, in the embodiment shown in FIGS. 8-10, an additional pair of arcuate ribs 186 are positioned centrally between longitudinal ends 165 of tubular support panel 164; however, in other embodiments, the number of arcuate ribs 186 of each panel assembly 162 may vary. Additionally, in other embodiments, each panel assembly 162 may not include arcuate ribs 186 and guide members 182 may couple with another component of the panel assembly 162 such as, for example, the central support member 170.

The arcuate ribs 186 positioned at the longitudinal ends 165 of tubing support panel 164 couple with (e.g., via fasteners, welded, etc.) the guide members 182 of guide assemblies 180 to attach guide members 182 to tubing support panel 164. In some embodiments, each guide member 182 may comprise a planar member or plate oriented orthogonal the radially inner surface 168 of the tubing support panel 164. The guide receptacle 184 formed between the pair of opposing guide members 182 of each guide assembly 180 may be configured to slidably receive one of the outer spokes 132 of one of the outer spoke assemblies 130. For example, the receptacle 184 of a first guide assembly 180 of a given panel assembly 162 may receive one of the outer spokes 132 of a first outer spoke assembly 130 while the receptacle 184 of a second guide assembly 180 (positioned opposite the first guide assembly 180) of a given panel assembly 162 may receive one of the outer spokes 132 of a second outer spoke assembly 130 positioned opposite the first outer spoke assembly 130.

The interaction between the guide assemblies 180 of each panel assembly 162 and the outer spoke assemblies 130 of support frame 102 (e.g., sliding contact between guide members 182 and outer spokes 132) may limit the degrees of freedom of the panel assembly 162 relative to the support frame 102. For example, referring to FIG. 11, the interaction or contact between guide assemblies 180 and outer spoke assemblies 130 may limit each panel assembly 162 to one degree of freedom relative to support frame 102—travelling rectilinearly between the radially inner and outer positions of the panel assembly 162 along a radius 185 extending from central axis 105 and centrally through the panel assembly 162 (e.g., extending through central support member 170 of the panel assembly 162) as controlled by the operation of actuation assembly 200. Thus, the interaction between the guide assemblies 180 of each panel assembly 162 and the outer spoke assemblies 130 may prevent panel assemblies 162 from pivoting or otherwise deviating from rectilinear travel along the radius 185 extending centrally through the panel assembly 162.

In this manner, an equidistant circumferential spacing 175 between adjacent panel assemblies 162 may be maintained when expandable reel is in both the retracted and expanded positions. However, the magnitude or size of the circumferential spacing 175 between adjacently positioned panel assemblies 162 may change in response to the actuation of core assembly 160 between the retracted and expanded configurations. Particularly, circumferential spacing 175 may increase in response to actuation of core assembly 160 from the retracted configuration to the expanded configuration. Circumferential spacing 175 may conversely decrease in response to actuation of core assembly 160 from the expanded configuration to the retracted configuration However, the circumferential spacing between each panel assembly 162 remains equidistant in both the retracted and expanded configurations.

Figure 11:
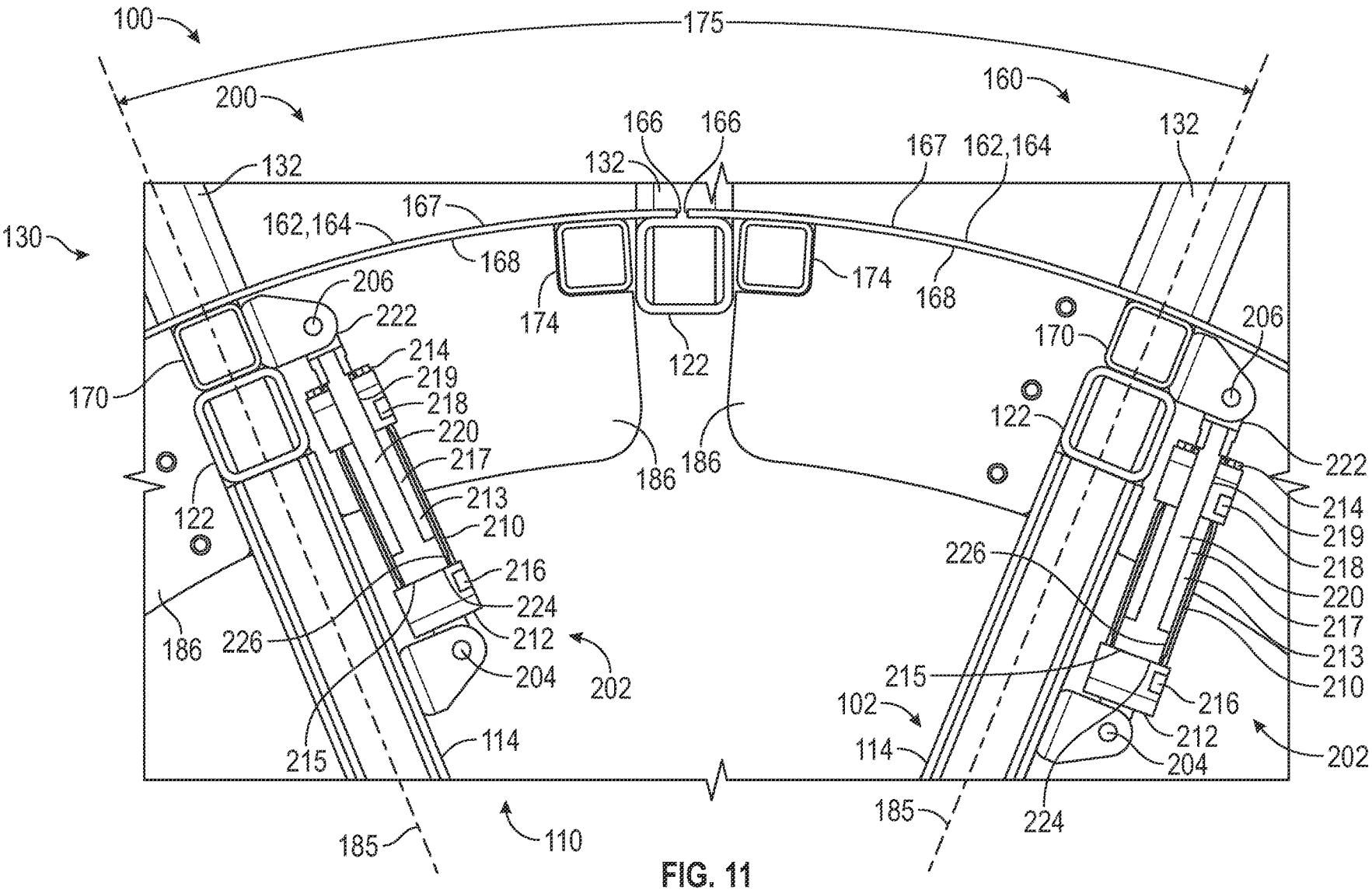
FIG. 11 is an orthogonal cross-sectional view along lines 11-11 of FIG. 5 of the expandable reel of FIG. 3.
Figure 12:
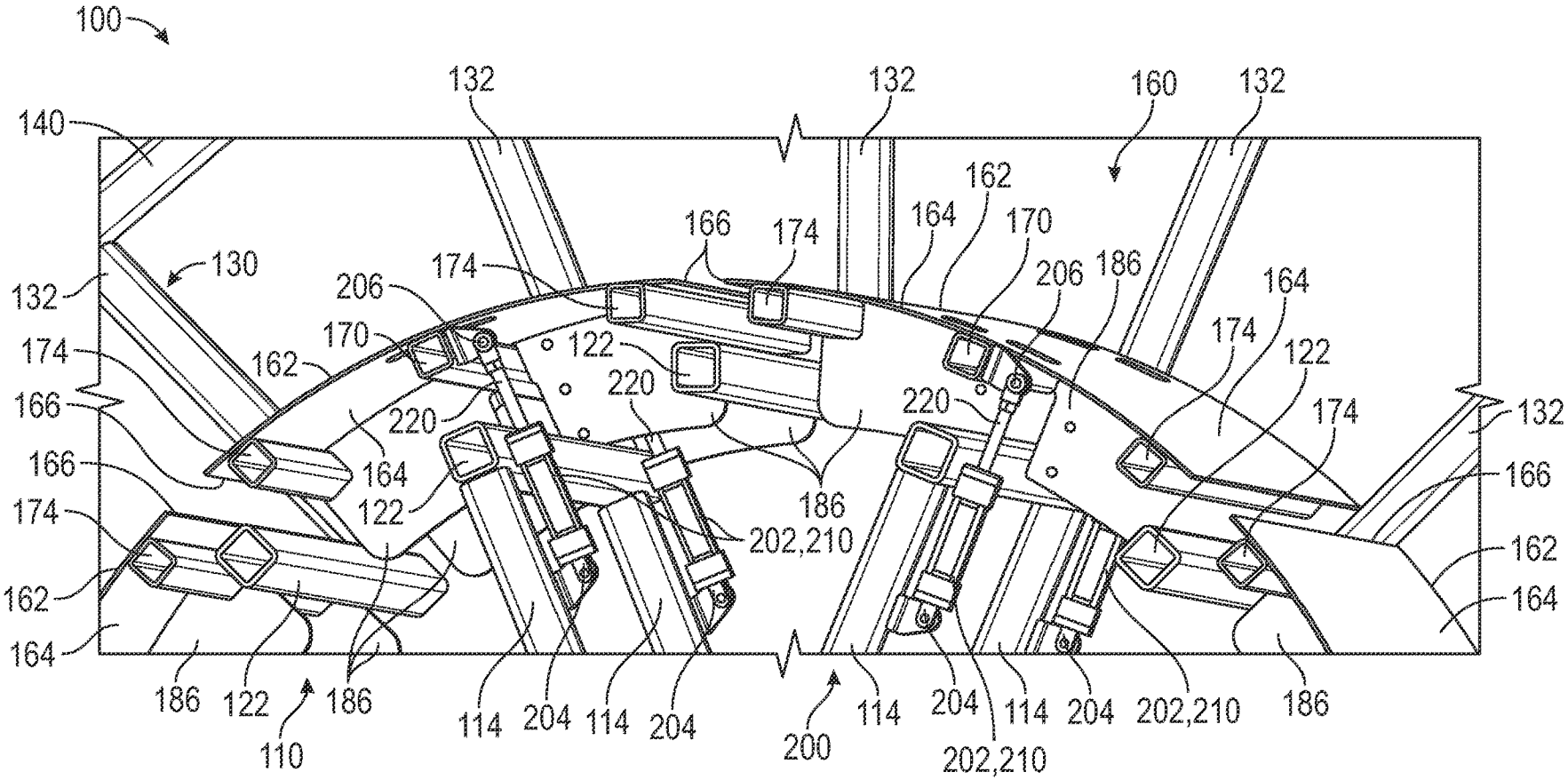
FIG. 12 is a perspective cross-sectional view along lines 12-12 of FIG. 5 of the expandable reel of FIG. 3.

Referring to FIGS. 11, 12, actuation assembly 200 of expandable reel 100 is generally configured to actuate expandable reel 100 between the retracted configuration (shown in FIG. 11) and the expanded configuration (shown in FIG. 12), and may generally include a plurality of circumferentially spaced actuators 202. In some embodiments, each actuator 202 may be coupled between one of the inner spokes 114 of inner spoke assemblies 110 and one of the panel assemblies 162 of core assembly 160 whereby the actuator 202 may displace the panel assembly 162 along the radius 185 extending therethrough between the radially inner (shown in FIG. 11) and radially outer (shown in FIG. 12) positions of the panel assembly 162.

In some embodiments, each actuator 202 of actuation assembly 200 generally comprises a linear actuator such as a hydraulic actuator including a cylinder 210 and a piston 220 slidably received in the cylinder 210. A radially inner end 212 of the cylinder 210 of each actuator 202 may be pivotably coupled to a first pivotable connector 204 while a radially outer end 222 of each piston, opposite the radially inner end 212 of the cylinder 210, may be pivotably coupled to a second pivotable connector 206. The first pivotable connector 204 may be coupled to (e.g., welded, etc.), or formed integrally with, one of the inner spokes 114 of inner spoke assemblies 110. Particularly, the radially inner end 212 of cylinder 210 may be pivotally coupled to one of the inner spokes 114 via first pivot connector 204 at a location proximal the radially outer end of the inner spoke 114. Additionally, the second pivotable connector 206 may be coupled to (e.g., welded, etc.), or formed integrally with, the central support member 170 of one of the panel assemblies 162 of core assembly 160. Thus, each actuator 202 of actuation assembly 200 may be coupled between one of the inner spoke assemblies 110 of support frame 102 and one of the panel assemblies 162 of core assembly 160.

The cylinder 210 of each actuator 202 may also comprise a radially outer end 214 opposite the radially inner end 212, a central passage 213 extending between ends 212, 214, a radially inner port 216, a radially outer port 218, and an annular seal assembly 219 located proximal the radially outer end 214 thereof. The piston 220 of each actuator may also comprise a radially inner end 224 opposite the radially outer end 222, and an annular seal 228 located proximal radially inner end 224. The annular seal 228 of piston 220 may sealingly engage an inner surface of cylinder 210 and may divide the central passage 213 of cylinder 210 into a first actuation chamber 215 and a second actuation chamber 217 that may be sealed or fluidically isolated from the first actuation chamber 215. First actuation chamber 215 is positioned between annular seal 226 and a radially inner end of the central passage 213 of cylinder 210, and second actuation chamber 217 is positioned between annular seal 226 and a radially outer end of central passage 213.

The radially outer end 222 of piston 220 may be extend and retract linearly along a radius extending parallel the radius 185 extending through the central support member 170 to which the radially outer end 222 of piston 220 is coupled. Particularly, the radially outer end 222 of piston 220 may be extended radially outwards away from cylinder 210 in response to the pressurization of first actuation chamber 215 and corresponding venting of second actuation chamber 217. Extension of the radially outer end 222 of piston 220 may force the panel assembly 162 coupled to the piston 220 radially outwards from the radially inner position of the panel assembly 162 to the radially outer position thereof. Conversely, the radially outer end 222 of piston 220 may be retracted radially inwards towards cylinder 210 in response to the venting of first actuation chamber 215 and the corresponding pressurization of second actuation chamber 217. Retraction of the radially outer end 222 of piston 220 may force the panel assembly 162 coupled to the piston 220 radially inwards from the radially outer position of the panel assembly 162 to the radially inner position thereof.

Although in the embodiment described above actuation assembly 160 comprises a plurality of hydraulic actuators (e.g., actuators 202), in other embodiments the configuration of actuation assembly 160 may vary. For example, in other embodiments, actuation assembly 160 may comprise one or more pneumatically or electrically powered actuators.

Referring briefly again to FIGS. 1, 2, expandable reel 100 may comprise a control system 230 generally configured to control the actuation of the actuators 202 of actuation assembly 200. In this embodiment, control system 230 may comprise a hydraulic control system configured to control the hydraulic pressurization and venting of the actuation chambers 215, 217 of each actuator 202 of actuation assembly 200. Although not specifically shown in FIGS. 1, 2, control system 230 may comprise a hydraulic fluid source, a pump, hydraulic lines, and other equipment for controlling the pressurization and venting of the actuation chambers 215, 217 of each actuator 202. In other embodiments, control system 230 may selectably supply pneumatic or electric power to actuators 202 (when actuators 202 comprise pneumatic or electric actuators) to control their operation. Control system 230 may include an input/output (I/O) unit through which personnel of coiled tubing system 20 may control the operation of actuation assembly 200 of expandable reel 100. In this manner, personnel of coiled tubing system 20 may selectably actuate expandable reel 100 between the retracted and expanded configurations. In other embodiments, control system 230 may be controlled a by a control system of the coiled tubing system 20.

Figure 13:
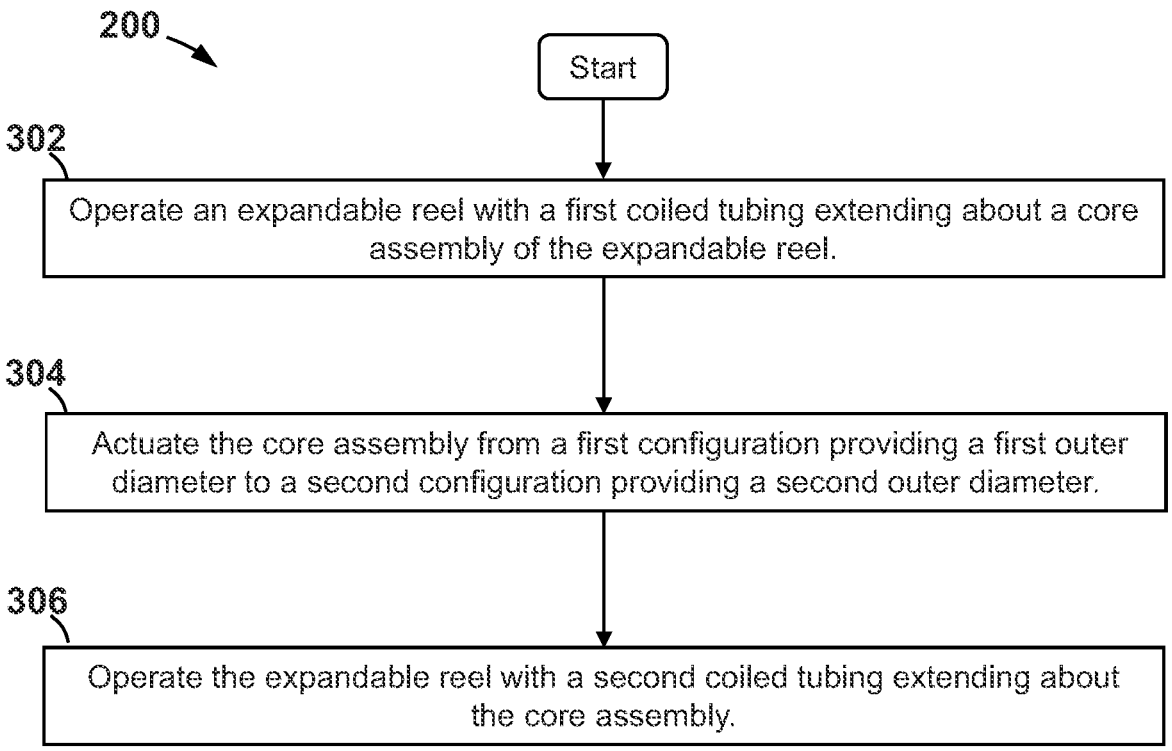
FIG. 13 is a flow chart of an embodiment of a method for operating an expandable reel for a well system in accordance with principles disclosed herein.

Referring to FIG. 13, a method 300 for operating a reel of a coiled tubing system is shown in FIG. 12. In some embodiments, method 300 may be practiced with expandable reel 100. Thus, in describing the features of method 300, continuing reference will be made to expandable reel 100. However, it should be appreciated that embodiments of method 300 may be practiced with other systems, assemblies, and devices. Additionally, one or more of the steps of method 300 may be individually repeated and/or a plurality of method steps may be repeated in sequential order) repeated. Further, the steps of method 300 described below need not be performed in the ordering described below and shown in FIG. 13.

Initially, method 300 includes operating an expandable reel with a first coiled tubing extending about a core assembly of the expandable reel at method block 302. Method block 302 may include unreeling the first coiled tubing from the core assembly of the expandable reel and/or reeling the first coiled tubing onto the core assembly when the core assembly is in a first configuration providing a first outer diameter. For example, method block 302 may include reeling and/or unreeling first coiled tubing 22 (shown in FIG. 1) from core assembly 160 of the expandable reel 100 to inject first coiled tubing 22 into wellbore 12 and/or retract first coiled tubing 22 from wellbore 12. As the first coiled tubing 22 is reeled and/or unreeled from core assembly 160, core assembly 160 may be in the retracted configuration shown in FIG. 1 where core assembly 160 comprises a first outer diameter 107. First outer diameter 107 may be defined by the radially outer surfaces 167 of the tubing support panels 165 of core assembly 160.

Method 300 proceeds at method block 304 by actuating the core assembly from a first configuration providing a first outer diameter to a second configuration providing a second outer diameter that is different from the first outer diameter. In some embodiments, the first coiled tubing may be removed from the expandable reel prior to actuating the core assembly from the first configuration to the second configuration. The first and second outer diameters of the core assembly may each be defined an outer surface of the core assembly. For example, core assembly 160 of expandable reel 100 may comprise a first outer diameter 107 and a second outer diameter 109 that is different from first outer diameter 107, where both the first and second outer diameters 107, 109 are defined by the radially outer surfaces 167 of the tubing support panels 164 of panel assemblies 162. In some embodiments, method 300 may include, in lieu of or in addition to method block 304, actuating the core assembly from the second configuration to the first configuration.

In some embodiments, the first outer diameter may be less than the second outer diameter. For example, the first outer diameter 107 of core assembly 160 shown in FIG. 1 may be less than the second outer diameter 109 of core assembly 160 shown in FIG. 2. Additionally, in some embodiments, the first configuration may correspond to the retracted configuration of core assembly 160 shown in FIGS. 1, 11 and the second configuration may correspond to the expanded configuration of core assembly 160 shown in FIGS. 2, 12.

Method block 304 may include operating an actuation assembly of the expandable reel to actuate the core assembly from the first configuration to the second configuration. For example, method block 304 may comprise operating the actuation assembly 200 of expandable reel to actuate core assembly 160 from the retracted configuration shown in FIGS. 1, 11 to the expanded configuration shown in FIGS. 2, 12. Method block 304 may also include operating one or more actuators of the actuator assembly (e.g., actuators 202 of actuation assembly 200) to actuate the core assembly from the first configuration to the second configuration. This may include supplying hydraulic, pneumatic, and/or electrical power to the actuators to control their operation. Method block 304 may further include operating a control system of the expandable reel (e.g., control system 230 shown in FIGS. 1, 2) to operate the actuation assembly and actuate the core assembly from the first configuration to the second configuration. Personnel of a coiled tubing system (e.g., coiled tubing system 20 shown in FIGS. 1, 2) may operate the control system through an I/O unit thereof. In other embodiments, the control system may be operated by a separate controller or control system, such as a control system for a coiled tubing system.

In some embodiments, method block 304 may include releasably and mechanically coupling or fastening (e.g., bolting, etc.) the guide members 182 of each guide assembly 180 to one of the outer spokes 132 of outer spoke assemblies 130 to secure core assembly 160 in the expanded configuration. Once mechanically secured in the expanded configuration, one or more actuators 202 of actuation assembly 200 may be depowered or depressurized. Guide members 182 of each guide assembly 180 may be decoupled from outer spokes 132 prior to core assembly 160 being actuated back into the retracted configuration.

Method 300 continues at method block 306 by operating the expandable reel with a second coiled tubing extending about the core assembly. Method block 306 may include unreeling the second coiled tubing from the core assembly and/or reeling the second coiled tubing onto the core assembly when the core assembly is in the second configuration providing the second outer diameter. For example, method block 306 may include reeling and/or unreeling second coiled tubing 23 (shown in FIG. 2) from core assembly 160 of the expandable reel 100 to inject second coiled tubing 23 into wellbore 12 and/or retract second coiled tubing 23 from wellbore 12. As the second coiled tubing 23 is reeled and/or unreeled from core assembly 160, core assembly 160 may be in the expanded configuration shown in FIG. 2 where core assembly 160 comprises second outer diameter 109.

Referring generally to FIGS. 1-13, the outer diameter (e.g., outer diameters 107, 109) of core assembly 160 may be altered when core assembly 160 is coupled to support frame 102. Thus, expandable reel 100 may provide a plurality of outer diameters for accommodating tubulars of various diameters without needing to exchange or replace core assembly 160. For instance, core assembly 160 may be disposed in the retracted configuration shown in FIGS. 1, 11 to receive the first coiled tubing 22 shown in FIG. 1. When it is desired to replace first coiled tubing 22 with second coiled tubing 23 shown in FIG. 2, first coiled tubing 22 may be removed from core assembly 160 and actuation assembly 200 may be operated (e.g., via personnel of coiled tubing system 20 using control system 230) to actuate core assembly 160 from the retracted configuration to the expanded configuration to thereby increase the outer diameter of core assembly 160 while core assembly 160 is coupled to support frame 102. Following the actuation of core assembly 160 into the expanded configuration, second coiled tubing 23 may be wound about core assembly 160 without subjecting second coiled tubing 23 to bending in excess of the minimum allowable bend radius of second coiled tubing 23.

In the manner described above, multiple coiled tubing strings of varying diameters may be deployed from expandable reel 100 without needing to replace core assembly 160, thereby minimizing the cost of operating expandable reel 100 and minimizing the amount of time for performing a coiled tubing operation using coiled tubing system 20.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An expandable reel for a well system, comprising:

a support frame configured to receive a torque from a motor, the support frame comprising a pair of outer hubs, a pair of outer spoke assemblies positioned within the pair of outer hubs and each comprising a plurality of circumferentially spaced outer spokes which extend radially outwards and couple with one of the pair of outer hubs, and a plurality of circumferentially spaced core support members which extend longitudinally between and couple with each plurality of circumferentially spaced outer spokes; and a core assembly configured to couple to the support frame and receive a tubular of the well system about an outer surface of the core assembly, wherein the core assembly is actuatable between a first configuration and a second configuration while remaining coupled to the support frame;

wherein the core assembly comprises a first outer diameter when in the first configuration and a second outer diameter when in the second configuration that is different from the first outer diameter.

2. The expandable reel of claim 1, wherein:

the support frame comprises a central axle and a pair of inner spoke assemblies located longitudinally between the pair of outer spoke assemblies and each comprising a plurality of circumferentially spaced inner spokes which extend radially outwards from the central axle and couple with the plurality of core support members;

the expandable reel further comprises a linear actuator coupled between the plurality of inner spokes of the support frame and the core assembly and configured to actuate the core assembly between the first configuration and the second configuration.

3. The expandable reel of claim 2, wherein the linear actuator comprises a cylinder coupled to the support frame and a piston at least partially disposed in the cylinder and coupled to the core assembly, wherein the piston is extendable from the cylinder.

4. The expandable reel of claim 2, further comprising a control system operable by a user of the expandable reel and configured to selectably operate the linear actuator to actuate the core assembly between the first configuration and the second configuration.

5. The expandable reel of claim 2, wherein the core assembly comprises a plurality of circumferentially spaced panel assemblies configured to radially translate relative to a central axis of the expandable reel in response to actuation of the linear actuator.

6. The expandable reel of claim 5, wherein each panel assembly comprises an arcuate panel and a support member coupled to the arcuate panel, wherein the arcuate panel comprises a radially outer surface that defines an outer surface of the core assembly and wherein the support member is configured to couple to the linear actuator.

7. The expandable reel of claim 6, wherein the plurality of core support members are positioned radially between the plurality of panel assemblies and the central axis of the expandable reel, wherein the plurality of panel assemblies are positioned between the pair of outer spoke assemblies.

8. The expandable reel of claim 7, wherein each panel assembly comprises a guide assembly configured to slidably engage one of the outer spokes of one of the outer spoke assemblies.

9. An expandable reel for a well system, comprising:

a support frame configured to receive a torque from a motor, the support frame comprising a pair of outer hubs a and a plurality of circumferentially spaced core support members which extend longitudinally between the pair of outer hubs;

a core assembly configured to couple to the support frame and receive a tubular of the well system about an outer surface of the core assembly, wherein the core assembly comprises a plurality of circumferentially spaced panel assemblies that are radially translatable relative to a central axis of the expandable reel; and a linear actuator coupled between the plurality of core support members of the support frame and the plurality of panel assemblies and configured to translate at least one of the plurality of panel assemblies radially relative to the central axis of the expandable reel.

10. The expandable reel of claim 9, wherein a circumferential spacing between each of the plurality of panel assemblies is increased in response to an actuation of the core assembly between a first configuration and a second configuration when coupled to the support frame.

11. The expandable reel of claim 9, wherein each panel assembly comprises an arcuate panel and a support member coupled to the arcuate panel, wherein the arcuate panel comprises a radially outer surface that defines an outer surface of the core assembly and wherein the support member is configured to couple to the linear actuator of the expandable reel.

12. The expandable reel of claim 11, wherein the support frame comprises a pair of inner spoke assemblies, the plurality of core support members are positioned radially between the plurality of panel assemblies and the central axis of the expandable reel, wherein the plurality of panel assemblies are positioned between the pair of outer spoke assemblies.

13. The expandable reel of claim 9, wherein each panel assembly comprises a guide assembly configured to limit the core assembly to a single degree of freedom relative to the support frame.

14. The expandable reel of claim 9, wherein the core assembly is actuatable between a first configuration and a second configuration when coupled to the support frame, and wherein the core assembly comprises a first outer diameter when in the first configuration and a second outer diameter that is different from the first outer diameter when in the second configuration.

15. The expandable reel of claim 14, further comprising the linear actuator coupled to the support frame and configured to actuate the core assembly between the first configuration and the second configuration.

16. A method for operating an expandable reel for a well system, comprising:

(a) actuating a linear actuator coupled between a plurality of longitudinally extending core support members of a support frame of the expandable reel and a plurality of panel assemblies of a core assembly of the expandable reel whereby the core assembly is actuated between a first configuration comprising a first outer diameter and a second configuration comprising a second outer diameter that is different from the first outer diameter, wherein the support frame comprises a pair of outer hubs, and a pair of outer spoke assemblies positioned within the pair of outer hubs and each comprising a plurality of circumferentially spaced outer spokes which extend radially outwards and couple with one of the pair of outer hubs; and (b) rotating the core assembly about a rotational axis relative to a support structure of the expandable reel to reel or unreel a first tubular having a first diameter from the core assembly.

17. The method of claim 16, further comprising:

(c) operating the expandable reel to reel or unreel the first tubular when the core assembly is in the first configuration; and (d) operating the expandable reel to reel or unreel a second tubular having a second diameter from the core assembly when the core assembly is in the second configuration, wherein the second diameter is different from the first diameter.

18. The method of claim 16, wherein (a) comprises increasing a circumferential spacing between each of the plurality of panel assemblies of the core assembly.

* * * * *